US010752420B2

(12) United States Patent
Gu

(10) Patent No.: US 10,752,420 B2
(45) Date of Patent: Aug. 25, 2020

(54) CORNER PROTECTOR AND PACKAGE STRUCTURE

(71) Applicant: Wuhan China Star Optoelectronics Technology Co., Ltd., Wuhan, Hubei (CN)

(72) Inventor: Hua Gu, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 391 days.

(21) Appl. No.: 15/580,600

(22) PCT Filed: Nov. 15, 2017

(86) PCT No.: PCT/CN2017/111046

§ 371 (c)(1),
(2) Date: Dec. 7, 2017

(87) PCT Pub. No.: WO2019/085027

PCT Pub. Date: May 9, 2019

(65) Prior Publication Data

US 2020/0031557 A1 Jan. 30, 2020

(30) Foreign Application Priority Data

Oct. 31, 2017 (CN) ..... 2017 1 1054130

(51) Int. Cl.
*B65D 81/05* (2006.01)

(52) U.S. Cl.
CPC ..... *B65D 81/057* (2013.01)

(58) Field of Classification Search
CPC .. B65D 81/057; B65D 81/058; B65D 81/056; B65D 81/054; B65D 81/055
USPC ..... 206/586, 37, 320
See application file for complete search history.

(56) References Cited

U.S. PATENT DOCUMENTS

| | | | | |
|---|---|---|---|---|
| 5,007,510 A * | 4/1991 | Houng | A45C 5/02 190/122 |
| 6,082,543 A * | 7/2000 | Beliveau | B65D 81/022 206/523 |
| 2009/0230016 A1* | 9/2009 | Rohrbach | B65D 81/056 206/586 |

FOREIGN PATENT DOCUMENTS

| | | |
|---|---|---|
| CN | 2475672 Y | 2/2002 |
| CN | 2658092 Y | 11/2004 |
| CN | 201006798 Y | 1/2008 |
| CN | 202743688 | 2/2013 |
| CN | 203428211 U | 2/2014 |
| CN | 105947673 | 9/2016 |
| CN | 205708164 U | 11/2016 |

(Continued)

*Primary Examiner* — King M Chu
(74) *Attorney, Agent, or Firm* — Hemisphere Law, PLLC; Zhigang Ma

(57) ABSTRACT

The present disclosure discloses a corner protector including a strip-shaped corner bead and a connector for connecting the corner bead, wherein the corner bead encloses a rectangular area, and the connector is connected between two adjacent sides of the corner beads. The corner protector of the present disclosure adopts a connector to connect the corner bead with higher hardness, which can ensure that the top edge of the package structure has higher hardness and is not easily broken. The corner protector can be split and assembled as needed, has the advantages of low cost, simple manufacture, simple transportation and storage, and convenient assembly and use.

20 Claims, 4 Drawing Sheets

(56) References Cited

FOREIGN PATENT DOCUMENTS

| | | |
|---|---|---|
| JP | 09150859 | 6/1997 |
| JP | 2003261165 | 9/2003 |
| JP | 2012035864 | 2/2012 |

* cited by examiner

CORNER PROTECTOR AND PACKAGE STRUCTURE

RELATED APPLICATIONS

The present application is a National Phase of International Application Number PCT/CN2017/111046, filed Nov. 15, 2017, and claims the priority of China Application No. 201711054130.3, filed Oct. 31, 2017.

BACKGROUND OF THE INVENTION

1. Field of the Invention

The present disclosure relates to a packaging technology field, and more particularly to a corner protector and a packaging structure.

2. The Related Arts

At the top of the existing pallet package, a paper cover is generally used as a waterproof and dustproof protective cover. Meanwhile, the corrugated paperboard can also provide some protection to prevent carton breakage when tying the tape. Ideally, the five-layer cardboard has good protection, but the hardness is too high. When incoming material, the five-layer cardboard cannot be folded, is not suitable for transport, is not suitable for storage, and is easily damaged in the unused state.

Currently, commonly used paper cover is a three-layer cardboard, the three-layer cardboard can be folded and suitable for shipping and storage. However, the hardness of the three-layer cardboard is weaker, especially the edge of the paper cover is easily broken by the machine during the banding operation, thereby losing the function of waterproofing, dustproofing and protecting the carton.

SUMMARY

In view of the shortcomings of the prior art, the present disclosure provides a corner protector and a package structure, which can ensure that the top edge of the package structure has higher hardness and is not easily broken, and the corner protector and the package structure have the advantages of low cost, simple manufacture, simple transportation and storage, and convenient assembly and use.

In order to achieve the above object, the present disclosure adopts the following technical solutions:

a corner protector, including a strip-shaped corner bead and a connector for connecting the corner bead, wherein the corner bead encloses a rectangular area, and the connector is connected between two adjacent sides of the corner beads.

As one of the embodiments, the corner bead is a plurality of corner beads, all of the corner beads are sequentially spliced into a rectangular, and the connector is connected between the opposite sides of the two adjacent corner beads.

As one of the embodiments, at least two of the corner beads are respectively arranged on two adjacent sides of a rectangular area surrounded by the corner beads and are connected by the connector arranged at the corner of the rectangular area surrounded by the corner beads.

As one of the embodiments, the number of the corner bead and the connector is four, every two of the four corner beads vertically to each other enclose a rectangular area, the connectors are L-shaped, and one of the connector is connected between every two adjacent corner beads.

As one of the embodiments, two sides of at least one of the corner bead bent are respectively arranged on two adjacent sides of a rectangular area surrounded by the corner beads.

As one of the embodiments, a dotted cut line is arranged on a bent portion of the corner bead.

As one of the embodiments, the connector is L-shaped, bottom surfaces of two sides of the connector are arranged with a tenon, sides of the two adjacent corner beads are respectively arranged in the tenons of the two sides of the connector.

As one of the embodiments, the number of the corner bead is one, the corner bead is divided into a plurality of segments in a length direction, and dotted cut lines are arranged between two adjacent segments, the corner bead enclose a rectangular area after being bent at the dotted cut line, and the connector is connected to two sides of the corner bead.

As one of the embodiments, the corner bead is divided into a plurality of segments in a length direction, the two segments at two sides of the corner bead are on a same side of the rectangular area, and the corner bead is respectively opened at two sides and provided with connecting holes; the connector includes a connection bar and two connecting posts protruding from a surface of the connecting bar, two of the connecting posts are arranged in one of the connecting hole respectively.

Another object of the present disclosure is to provide a package structure including a box and a corner protector, wherein the corner protector is arranged on an edge of a top of the box.

The corner protector of the present disclosure adopts a connector to connect the corner bead with higher hardness, which can ensure that the top edge of the package structure has higher hardness and is not easily broken. The corner protector can be split and assembled as needed, has the advantages of low cost, simple manufacture, simple transportation and storage, and convenient assembly and use.

DETAILED DESCRIPTION OF THE PREFERRED EMBODIMENTS

In order to make the objectives, technical solutions and advantages of the present disclosure more comprehensible, the present disclosure is further described in detail below with reference to the accompanying drawings and embodiments. It should be understood that the specific embodiments described herein are merely used to explain the present disclosure, and are not intended to limit the present disclosure.

Embodiment 1

Figure 1:
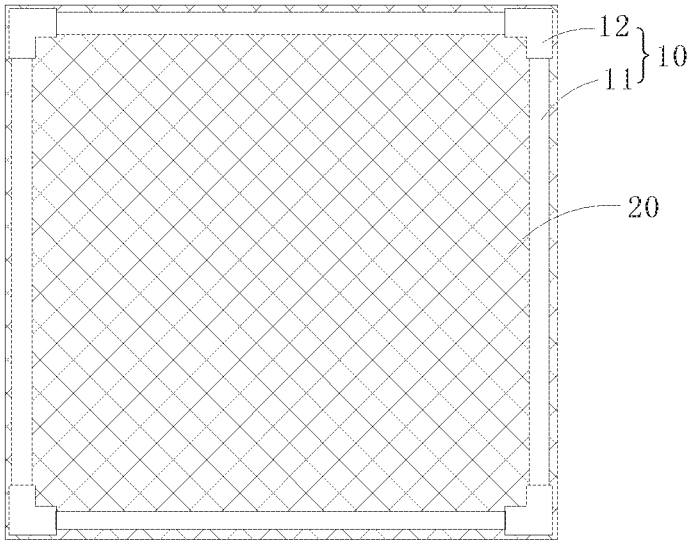
FIG. 1 is a schematic structural diagram of the package structure according to Embodiment 1 of the present disclosure.

Referring to FIG. 1, the package structure of the present embodiment includes a corner protector 10 and a box 20, a tray loaded with a product such as a liquid crystal panel may be stacked in the box 20, the corner protector 10 is arranged on the edge of the top of the box 20. When the box 20 is laced, the corner frame 10 can serve as a reinforcement of the box 20 to improve the anti-deformation capability of the edge of the packaging structure, and to avoid the edges of the package structure being broken or sunken resulting in damage or contamination of the inner package.

Figure 2:
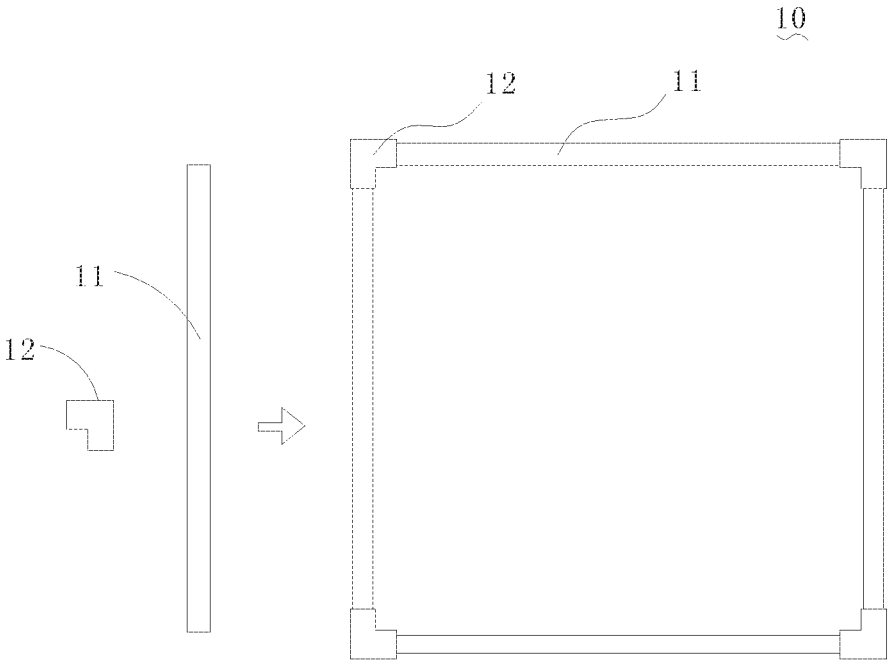
FIG. 2 is a schematic diagram of the process of assembling the corner protector according to Embodiment 1 of the present disclosure.

In conjunction with FIG. 2, the corner protector 10 of the present embodiment includes a corner bead 11 and a connector 12 for connecting the corner bead 11, the corner bead 11 is a plurality of corner beads 11, all of the corner beads 11 are sequentially spliced into a rectangular, and the connector 12 is connected between the opposite sides of the two adjacent corner beads 11.

In the present embodiment, four long flat plate-shaped corner beads 11 surrounded by a rectangular area, the connector 12 is connected between two adjacent sides of the corner beads 11. Specifically, every two of the four corner beads 11 are perpendicular to each other, and four connectors 12 are respectively disposed at the four corners of the rectangular area to connect the adjacent sides of the two adjacent corner beads 11 together.

Figure 3A:
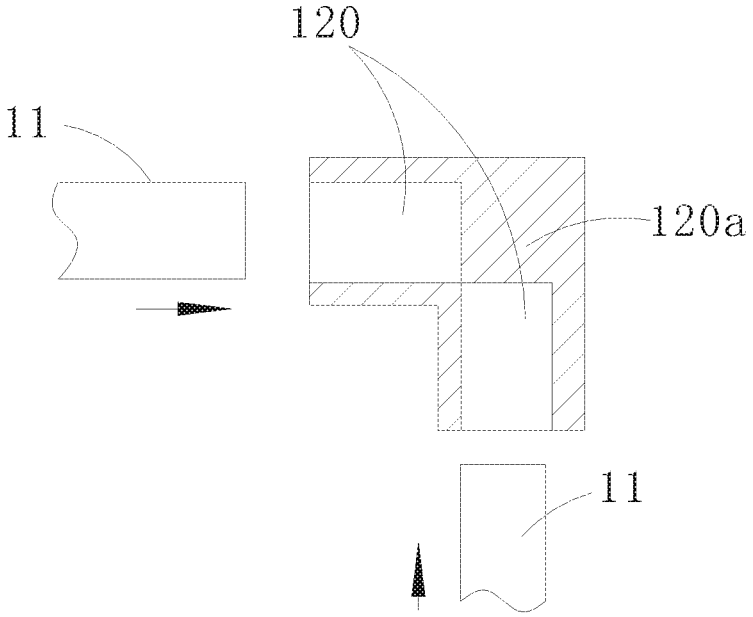
FIG. 3*a* is a schematic structural diagram of a connector according to Embodiment 1 of the present disclosure.

In conjunction with FIG. 3*a*, the connector is L-shaped, two sides of the L shape are respectively connected with the sides of one corner bead 11. Specifically, bottom surfaces of the two sides of the connector 12 is arranged with a tenon 120 respectively, the opposite sides of the two adjacent corner beads 11 are arranged in the different tenons 120 at both sides of the same connector 12. The connector 12 is made of plastic, and the corner bead 11 can be made of a material with a higher hardness than the box 20, such as five-layer cardboard or plastic. The corner bead 11 and the tenon 120 are interference fit, so that the corner bead 11 and the connector 12 are assembled with a certain degree of reliability. Serrated protrusions may be arranged on the side wall of the tenon 120 and the side of the corner bead 11 respectively, when the corner bead 11 is inserted into the tenon 120, there is a certain damping strength between the two, so that the two can be easily separated.

FIG. 3*a* shows the case where the side of the corner bead 11 is a regular rectangle, the tenons 120 at both sides of the connector 12 are also correspondingly rectangular slots, the two adjacent tenons 120 are separated by a convex square portion 120*a*, and two adjacent sidewalls of the square portion 120*a* are one sidewall of the two tenons 120 respectively. After the two corner beads 11 are inserted into the same connector 12, the sides of the two corner beads 11 abut on the side wall surfaces of the square portion 120*a* respectively.

Figure 3B:
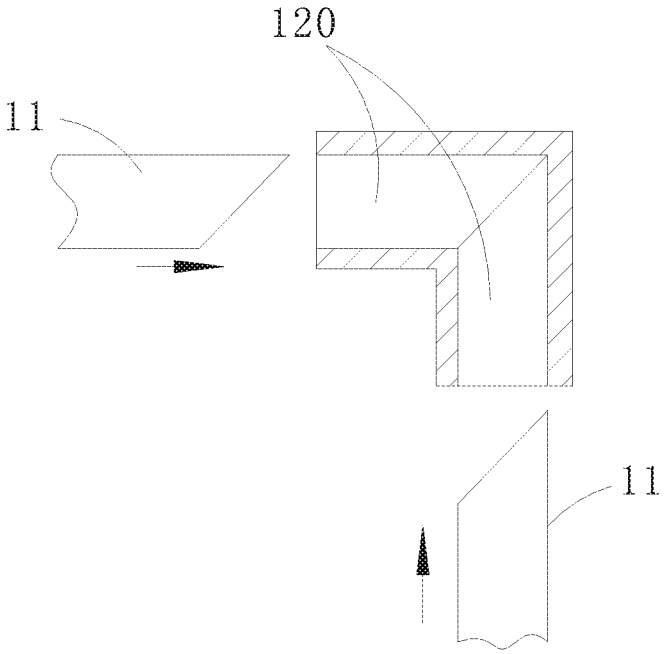
FIG. 3*b* is a schematic structural diagram of another connector according to Embodiment 1 of the present disclosure.

FIG. 3*b* shows the case where the side of the corner bead 11 is wedge-shaped, correspondingly, the tenon 120 at both sides of the connector 12 are also correspondingly wedge-shaped grooves. The two tenons 120 are connected to form an L-shaped groove, after the two corner beads 11 are inserted into the connector 12, the sides of the corner beads 11 are abutted with each other and bonded to each other, thereby enhancing the assembly stability of the corner bead 11 and the connector 12.

Due to the corner bead 11 and the connector 12 of the corner protector 10 can be separately manufactured and packaged. When the user needs to use, simply insert each corner bead 11 into the connector 12 to form a substantially rectangular frame, and then place or stick it on the edge of the top surface of the box 20, which is convenient for disassembling and using. Moreover, when it is necessary to change the frame size of the corner protector 10, it is only necessary to cut the corner bead 11 with a new length. The connector 12 can be used continuously and compatible with the corner bead 11 of different lengths, which improves the compatibility of the corner protector 10 and reduces the maintenance cost.

Embodiment 2

Figure 4:
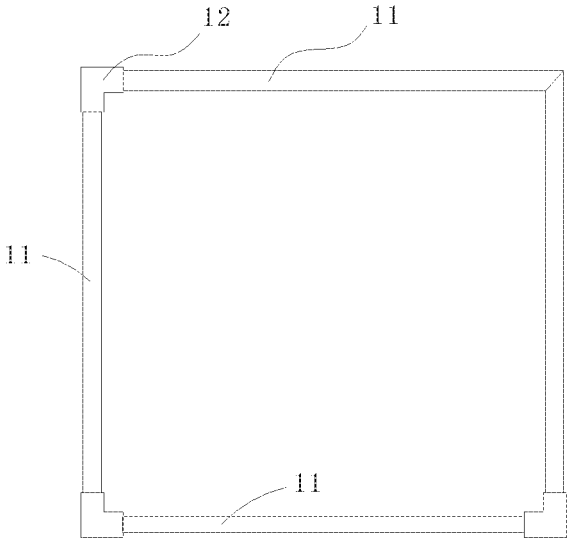
FIG. 4 is a schematic structural diagram of the corner protector according to Embodiment 2 of the present disclosure.

As shown in FIG. 4, different from the embodiment 1, in the present embodiment, there are three corner beads 11 and three connectors 12, the two corner beads 11 are respectively arranged on two adjacent sides of the rectangular area surrounded by the corner bead 11 and connected by a connector 12 provided at the corner of the rectangular area enclosed by the corner bead 11. The length of the other corner 11 is the largest, forming two segments after bending, two corners of the corner bead 11 are respectively arranged on two other sides of the corner protector 10, and two sides of the corner bead 11 are respectively connected to a side of a corner bead 11 by a connector 12.

Figure 5:
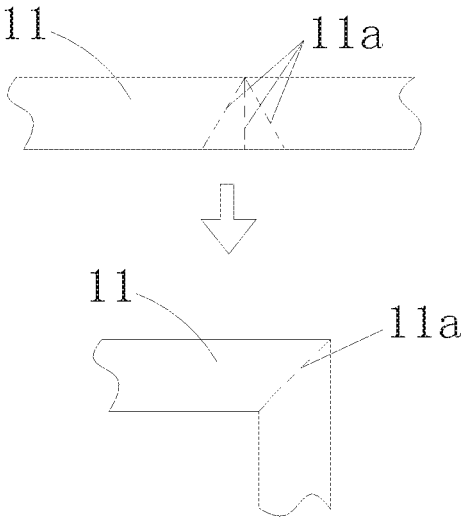
FIG. 5 is a schematic diagram of the bending process of a corner bead according to Example 2 of the present disclosure.

The corner protector 10 of the embodiment omits one connector 12, and can still be disassembled conveniently. As shown in FIG. 5, The bending portion of the longest corner bead 11 is provided with dotted cutting lines 11*a*, the number of the cutting lines 11*a* is three, one of the cutting line 11*a* is arranged perpendicular to the length direction of the corner bead 11 and the other two cutting lines 11*a* are inclined at 45° with respect to the cutting line 11*a* and symmetrically arranged on both sides of the cutting line 11*a* in the middle. When the corner bead 11 is bent, the portions having the cutting lines 11*a* on both sides are abutted together, the portion of the cutting line 11*a* in the middle is arched, the two sides of the corner bead 11 are respectively inserted into a connector 12 and then combined with the sides of the remaining corner bead 11 which is assembled and then can be pasted or placed on the top surface of the box 20.

Embodiment 3

Figure 6:
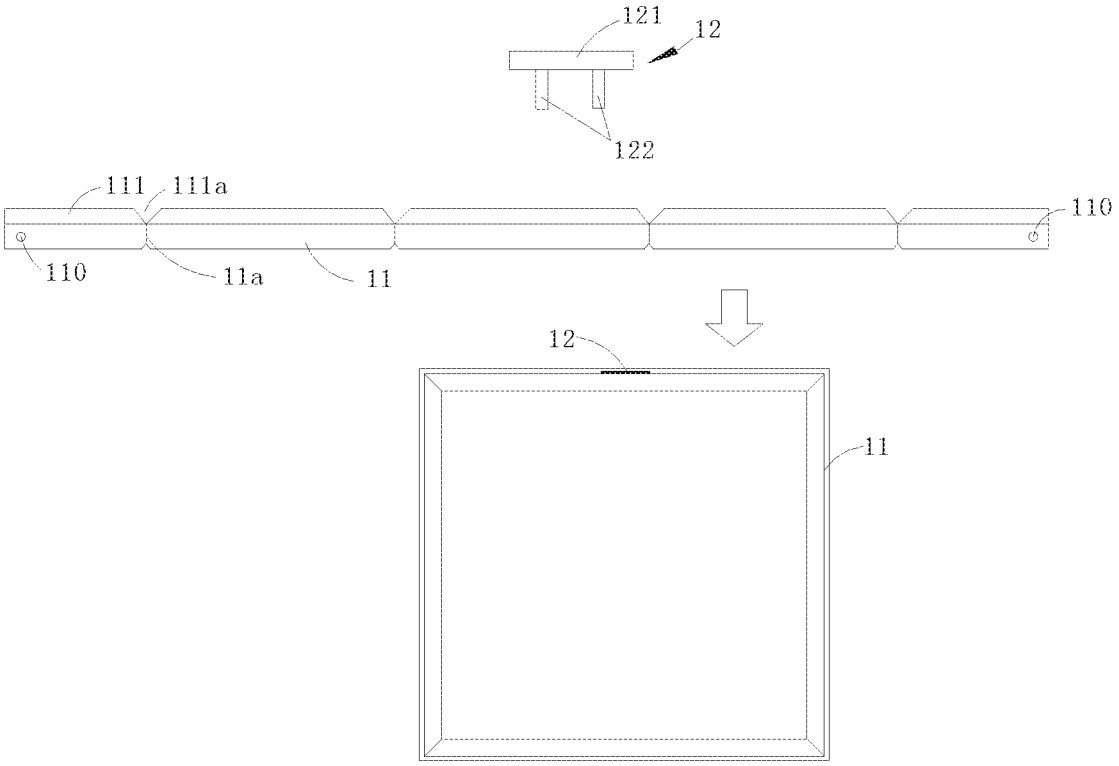
FIG. 6 is a schematic diagram of the assembling process of the corner protector according to Embodiment 3 of the present disclosure.

As shown in FIG. 6, different from the embodiment 1, the number of the corner bead 11 of the present embodiment is one, the corner bead 11 is divided into a plurality of segments in the length direction and dotted cutting lines 11*a* are provided between two adjacent segments. The corner bead 11 is bent into a rectangular area at the cutting line 11*a*, and the connector 12 is connected to two sides of the corner bead 11.

In the present embodiment, the corner bead 11 is divided into five segments in the length direction, the middle three segments are equal in length, the two sections at two sides are respectively half the length of the middle segment. Two segments of both sides of the corner bead 11 are provided on the same side of the corner protector 10, and the corner bead 11 is respectively opened at two sides and provided with connecting holes 110. The connector 12 includes a connecting bar 121 and two connecting posts 122 protruding from the surface of the connecting bar 121 at intervals. When the corner bead 11 is folded into a rectangular shape, opposite sides of the corner bead 11 are arranged oppositely. Two connecting posts 122 are respectively arranged in one of the connecting hole 110 to connect the corner bead 11 as a closed rectangular frame. When the rectangular frame is spliced, it is only necessary to cover the side wall on the top of the box 20.

It can be understood that the lengths of the two segments at two sides may not be equal, only the sum of the lengths of the two segments should be consistent with the lengths of the other segments, and the splicing of the closed rectangular frame cannot be affected.

In addition, each segments of the corner bead 11 may further include a folded portion 111 extending in the width direction, a triangular groove 111*a* is formed between two adjacent folded portions 111. When the corner bead 11 is bent into a rectangular frame, all the folded portions 111 are folded toward the middle of the rectangular frame. When the corner protector 10 is used, it is only necessary to provide the corner protector 10 on the side wall of the top of the box 20 and to make the folded portions 111 fit on the edge of the top surface of the box 20, the surface of the box 20 is fixedly adhered to the surface of the box 20 by using a paste or the like so that the corner protector 10 can simultaneously protect the top surface and the side surfaces of the box 20. Alternatively, the folded portions 111 may be connected to each other, the connection between the folded portions 111 may be replaced by the groove 111*a* of the present embodiment by using the arrangement of the cutting lines 11*a* between the two segments of the longest corner bead 11 shown in the second embodiment.

In summary, the corner protector of the present disclosure adopts a connector to connect the corner bead with higher hardness, which can ensure that the top edge of the package structure has higher hardness and is not easily broken. The corner protector can be split and assembled as needed, has the advantages of low cost, simple manufacture, simple transportation and storage, convenient assembly and use, and improving the yield.

The foregoing descriptions are merely specific implementation manners of the present application. It should be noted that, for those skilled in the art, several improvements and modifications can be made without departing from the principle of the present disclosure, and these improvements and modifications should also be considered as the protection scope of the present application.

What is claimed is:

1. A corner protector, comprising a strip-shaped corner bead and at least one connector for connecting the corner bead, wherein the corner bead has side portions to surround a rectangular area, one of the at least one connector is connected between two adjacent ones of the side portions of the corner bead, the one connector is L-shaped, bottom surfaces of two sides of the one connector are arranged with tenons or mortises, and two adjacent ends of the two adjacent side portions are respectively engaged with corresponding mortises or tenons on the two sides of the one connector.

2. The corner protector according to claim 1, wherein all of the side portions are spliced into a rectangle, and the one connector is connected between the two adjacent ends of the two adjacent side portions.

3. The corner protector according to claim 2, wherein the two adjacent side portions are respectively arranged on two adjacent sides of the rectangular area surrounded by the corner bead and are connected by the one connector arranged at a corner of the rectangular area surrounded by the corner bead.

4. The corner protector according to claim 3, wherein the side portions comprises four separate side portions and the at least one connector comprises four connectors, every two adjacent ones of the four side portions are perpendicular to each other to form the rectangle, and the every two adjacent side portions are connected by a corresponding one of the connectors.

5. The corner protector according to claim 3, wherein the corner bead has a bent portion between another two adjacent ones of the side portions, and the another two adjacent side portions are respectively arranged on another two adjacent sides of the rectangular area surrounded by the corner bead.

6. A corner protector, comprising a strip-shaped corner bead and at least one connector for connecting the corner bead, wherein the corner bead has side portions to surround a rectangular area, one of the at least one connector is connected between two adjacent ones of the side portions of the corner bead, the corner bead has a bent portion between another two adjacent ones of the side portions wherein a dotted cut line is arranged on the bent portion of the corner bead, and the another two adjacent side portions are respectively arranged on two adjacent sides of the rectangular area surrounded by the corner bead.

7. The corner protector according to claim 6, wherein the corner bead is a straight corner bead before being bent and comprises the side portions arranged in a length direction, dotted cut lines are arranged between every two adjacent ones of the side portions, the corner bead surrounds a rectangular area after being bent at the dotted cut lines, and the connector is connected to two ends of the straight corner bead.

8. The corner protector according to claim 7, wherein the side portions comprises a head side portion and a tail side portion arranged on the same side of the rectangular area, connecting holes are formed on the head side portion and the tail side portion, the connector comprises a connection bar and connecting posts protruding from a surface of the connecting bar, and the connecting posts are arranged in the connecting holes respectively to fix the head side portion and the tail side portion together.

9. The corner protector according to claim 8, wherein each side portion of the corner bead further comprises a fold-over portion extending in a width direction, and when the corner bead is bent to surround the rectangular area, all the fold-over portions are folded toward the rectangular area surrounded by the corner bead.

10. The corner protector according to claim 9, wherein a triangular groove is arranged between every two adjacent ones of the fold-over portions.

11. A package structure, comprising a box and a corner protector, wherein the corner protector is arranged on edges of a top of the box, the corner protector comprising a strip-shaped corner bead and at least one connector for detachably connecting the corner bead, the corner bead has side portions which are connected in an end-to-end manner to form a closed loop surrounding a rectangular area, and one of the at least one connector is connected between two adjacent ones of the side portions of the corner bead.

12. The package structure according to claim 11, wherein all of the side portions are spliced into a rectangle, and the one connector is connected between two adjacent ends of the two adjacent side portions.

13. The package structure according to claim 12, wherein the two adjacent side portions are respectively arranged on two adjacent sides of the rectangular area surrounded by the corner bead and are connected by the one connector arranged at a corner of the rectangular area surrounded by the corner bead.

14. The package structure according to claim 13, wherein the side portions comprises four separate side portions and the at least one connector comprises four connectors, every two adjacent ones of the four side portions are perpendicular to each other to form the rectangle, and the every two adjacent side portions are connected by a corresponding one of the connectors.

15. The package structure according to claim 13, wherein the corner bead has a bent portion between another two adjacent ones of the side portions, and the another two adjacent side portions are respectively arranged on another two adjacent sides of the rectangular area surrounded by the corner bead.

16. The package structure according to claim 15, wherein a dotted cut line is arranged on the bent portion of the corner bead.

17. The package structure according to claim 13, wherein the one connector is L-shaped, bottom surfaces of two sides of the one connector are arranged with tenons or mortises, and the two adjacent ends of the two adjacent side portions are respectively engaged with corresponding mortises or tenons on the two sides of the connector.

18. The package structure according to claim 11, wherein the corner bead is a straight corner bead before being bent and comprises the side portions arranged in a length direction, dotted cut lines are arranged between every two adjacent ones of the side portions, the corner bead surrounds the rectangular area after being bent at the dotted cut lines, and the one connector is connected to two ends of the straight corner bead.

19. The package structure according to claim 18, wherein the side portions comprises a head side portion and a tail side portion arranged on the same side of the rectangular area, connecting holes are formed on the head side portion and the tail side portion, the connector comprises a connection bar and connecting posts protruding from a surface of the connecting bar, and the connecting posts are arranged in the connecting holes respectively to fix the head side portion and the tail side portion together.

20. The package structure according to claim 18, wherein each side portion of the corner bead further comprises a fold-over portion extending in a width direction, when the corner bead is bent to surround the rectangular area, all the fold-over portions are folded toward the rectangular area surrounded by the corner bead, and a triangular groove is arranged between every two adjacent ones of the fold-over portions.

* * * * *